United States Patent [19]

Leth-Sørensen

[11] Patent Number: 4,515,277

[45] Date of Patent: May 7, 1985

[54] HOLDER WITH A PLURALITY OF SPRING CLIPS FOR SUSPENSION OF SHEET MATERIAL

[76] Inventor: Thomas Leth-Sørensen, Gabelsparken 259, DK-6740 Bramming, Denmark

[21] Appl. No.: 486,957

[22] PCT Filed: Aug. 11, 1982

[86] PCT No.: PCT/DK82/00076

§ 371 Date: Apr. 4, 1983

§ 102(e) Date: Apr. 4, 1983

[87] PCT Pub. No.: WO83/00423

PCT Pub. Date: Feb. 17, 1983

[51] Int. Cl.[3] ..... A47F 5/08

[52] U.S. Cl. ..... 211/45; 211/89

[58] Field of Search ..... 211/89.45, 6, 16; 248/316.1, 316.6, 316.7

[56] References Cited

U.S. PATENT DOCUMENTS

| | | | |
|---|---|---|---|
| 2,002,566 | 5/1935 | Conigrave | 211/89 |
| 2,081,817 | 5/1937 | Johnson | 211/89 X |
| 2,462,051 | 2/1949 | Stan | 211/89 |
| 2,466,195 | 4/1949 | Anderson et al. | 211/89 |
| 2,725,147 | 11/1955 | Vogler | 211/89 X |

FOREIGN PATENT DOCUMENTS

| | | | |
|---|---|---|---|
| 21586 | of 1910 | United Kingdom | 211/45 |
| 1142211 | 2/1969 | United Kingdom | 211/45 |

*Primary Examiner*—Robert W. Gibson, Jr.
*Attorney, Agent, or Firm*—Murray, Whisenhunt & Ferguson

[57] ABSTRACT

A holder with a plurality of spring clips for suspension of sheet material comprises two components, viz. a main housing 10, 11, 12 with a plurality of rectangular projections forming side walls in a plurality of cases 14, and a spring component comprising a plurality of clamping discs 19 which, by springs 18, are suspended from a mounting plate 13 forming a cover for the main housing 10.

Each of the two components are manufactured in one piece by moulding in plastics. A corner of each case 14 (spring case) is provided with a wedge-shaped opening 17 for receiving a clamping disc 19 so that a part of this disc extends beyond the case 14, and a spring 18 inside the case keeps the disc resiliently engaged with an end face 15 of an adjacent case.

The clamping discs 19 are mounted in their operational position by insertion of the spring clip component 13, 18, 19 in the main housing 10.

4 Claims, 2 Drawing Figures

HOLDER WITH A PLURALITY OF SPRING CLIPS FOR SUSPENSION OF SHEET MATERIAL

Figure 1:
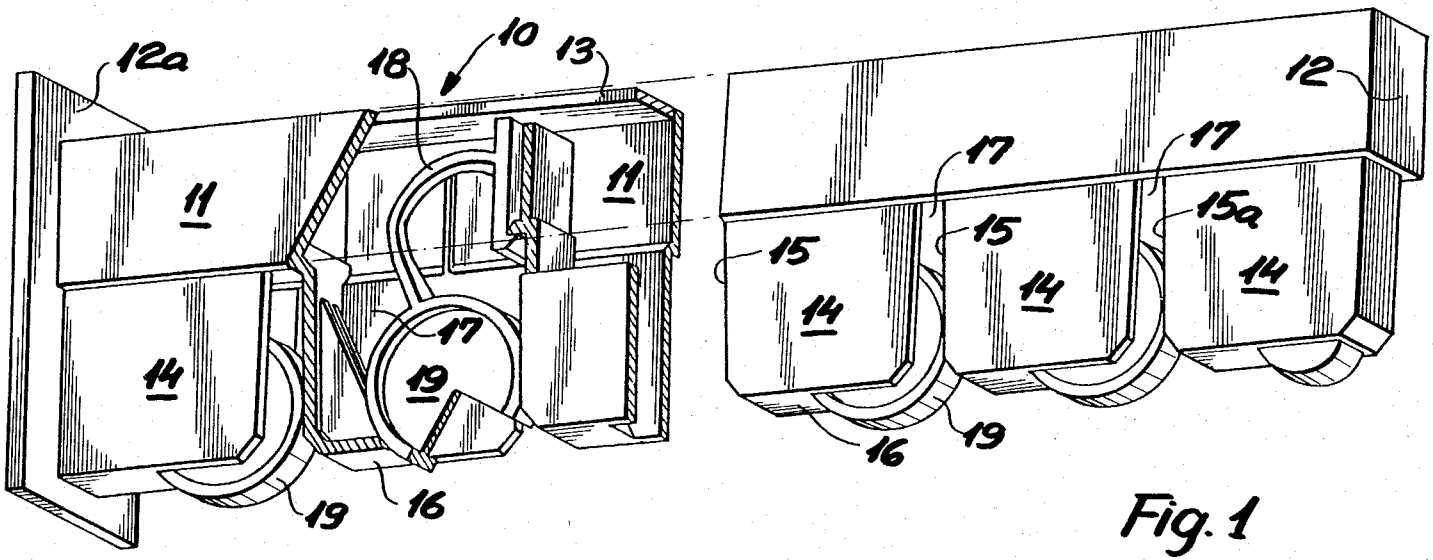

The invention relates to a holder with a plurality of spring clips of the type used for suspension of sheet material, such as photographic film or paper material.

Holding means of this type are known in several different embodiments.

Thus, it is known to use balls or discs as clamping means, and it is also known to use springs or spring-loaded members as holding means.

The known holding means of this type, which are described e.g. in the U.S. Pat. Nos. 3,159,281, 3,262,579, 2,964,197, and 4,194,635 are composed of several different constructional parts consisting of different materials, which makes the production of them relatively complicated and expensive.

The object of the present invention is to provide a holder of the said type having a plurality of clamping means formed as spring clips, which can be manufactured by a simple and economically advantageous plastics moulding process with a minimized consumption of materials and without noticeable mounting work.

These advantages in terms of production in connection with an operationally particularly expedient embodiment of a holder of the said type are obtained according to the invention by constructing the holder so that each spring clip is formed by a disc located in a corner of a box-shaped case, a spring inside the spring case keeping the disc clamped against an engagement face disposed outside the spring case.

Such a holder differs significantly from the prior art in that the spring clips mounted in the holder are formed by the cooperation of simple discs (clamping discs) moulded in plastics with a flat engagement face with which the clamping disc of each spring clip is kept resiliently engaged by a spring housed in a case (spring case) likewise moulded in plastics.

One part of the spring clip, viz. the engagement face for a clamping disc mounted in the corner of a spring case, may expediently be formed by an end face in an adjacent case. Thus, the available case faces may be used as one part of the spring clip.

When the clamping disc is disposed in a wedge-shaped opening in a corner of a spring case containing the spring which acts on the clamping disc, the spring pressure will affect the clamping disc with a component of force acting on the engagement face of the adjoining spring case.

With a view to simplifying the manufacturing process the clamping disc and the spring of each spring clip may be made integral with a common mounting plate, and the unit thus formed may then be inserted into one end of a main housing whose other end is contiguous with the spring cases.

Finally, one end of the outermost spring clips on a part of the main housing may be formed with an engagement face for the clamping disc in this spring clip, and this part may then be constructed in the same manner as the cases of the spring clips.

The invention will be described below with reference to the embodiments shown in the drawing.

Figure 2:
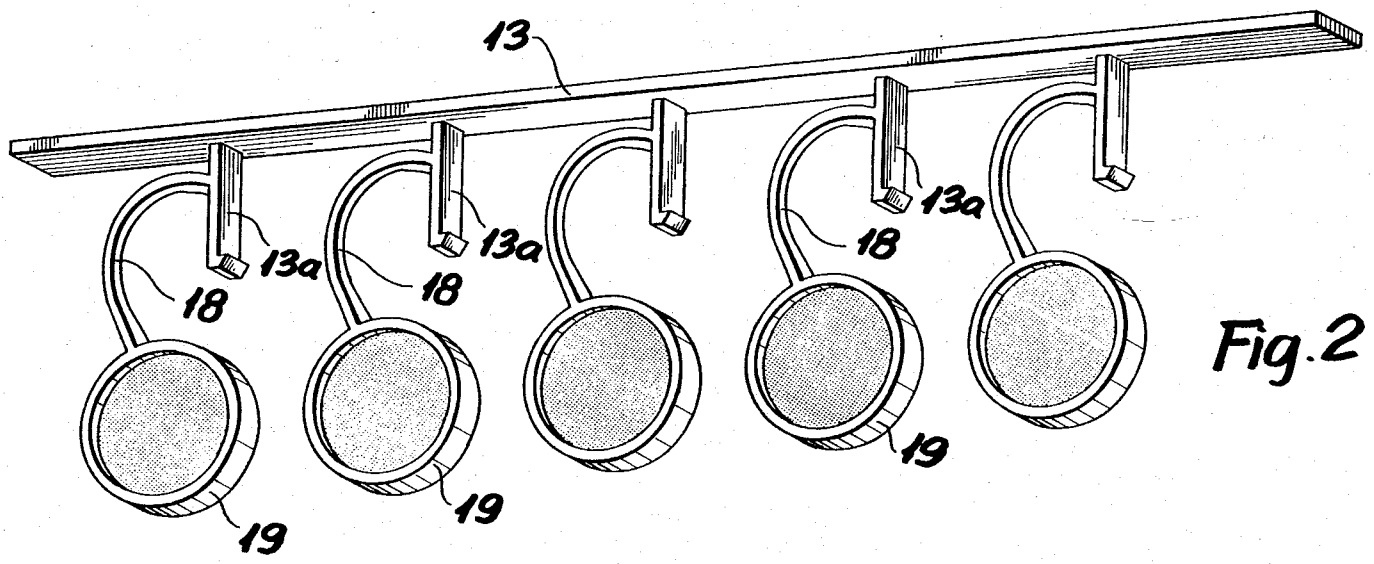

In the drawing:

FIG. 1 shows an embodiment of a holder with six spring clips, seen in perspective and partly in section, and FIG. 2 shows a part of the same holder, likewise seen in perspective.

The holder shown in FIG. 1 comprises an elongated hollow body 10, which is defined by a pair of side walls 11 and end walls 12 and is closed at one end by a cover 13 formed as a mounting plate. At the opposite side the side walls 11 of the hollow body are formed with a plurality of rectangular projections constituting side walls in a plurality of cases 14, which are closed by end walls 15 and 16 and whose cavities open into the hollow body 10. A substantially wedge-shaped cut-out 17 is provided in a corner of each case 14 and serves to receive a clamping disc 19 suspended from a spring 18; the clamping disc extends partly beyond the case 14 and resiliently engages an end wall 15 of an adjacent case 14.

FIG. 2 shows how the six clamping discs 19 are suspended from hook-shaped, resilient projections **13*a* on the internal surface of the mounting plate 13 by means of arc-shaped springs 18 enclosing the clamping discs 19 at one end. In this embodiment the clamping discs 19 and springs 18 are made integral with the mounting plate 13, and this unit, preferably moulded in plastics, is mounted in the holder by insertion into the hollow body 10, where it is retained by the engagement of the hook-shaped projections 13*a* with corresponding projections in the inside of the hollow body 10. Each of the spring clips mounted on the holder 10 is thus formed by the resilient engagement of a part of a clamping disc 19 with an end face 15 of an adjacent case; however, the clamping disc in the outermost spring clip which has no adjacent case engages a corresponding engagement face 15*a* in a part of the holder 10**.

In the embodiment shown in FIG. 1 one end wall of the hollow body 10 is formed by a plate-shaped holding means **12*a*** which is slidably mounted in a wall rail not shown in the drawing.

It will be seen that the hollow body 10 with the members provided in it forms a housing, which in the preamable to the description is called main housing, while the cases 14 with the springs 18 housed in them are called spring cases.

I claim:

1. A holder for suspension of sheet material, comprising an elongated support member formed integrally with a plurality of spaced apart, downwardly projecting spring members each of which carries at its free end a clamping disc, a box-shaped case member having a bottom portion and a pair of side walls, said box-shaped case member being connectable to the support member and having a plurality of compartments with partitions therebetween for receiving respective clamping discs, each partition having an abutment against which the clamping disc in an adjacent compartment is positioned, and said box-shaped case member having openings in its bottom portion through which a portion of respective clamping discs extend and slots formed in its side walls for receiving the sheet material to be suspended.

2. A holder as claimed in claim 1 wherein said case member includes means for supporting the support member when the support member is inserted into the case member through a lengthwise extending aperture in the upper part of the case member and wherein the ends of the spring members are provided with hook shaped projections adapted to grip complementary projections in the case member.

3. A device comprising a plurality of spring clips for detachably supporting photographic films or other sheet material, characterized by an assembly of the following two components:

(a) a housing adapted to be mounted in a horizontal position on a wall or similar support and having an elongated box-shaped unit having a pair of side walls and a pair of end walls defining a cavity, and a lengthwise extending aperture in the upper part of the housing, a plurality of downwardly extending clip cases having side walls integral with the side walls of the housing, a bottom wall and a pair of end walls defining a cavity which communicates with the cavity of the housing, each of said clip cases having an aperture in the bottom wall and in an adjacent end wall at one corner of the clip case, and (b) a spring clip unit adapted to be mounted in the housing and comprising an elongated plate member and a plurality of downwardly extending spring supporting members integral with the plate member, each of said supporting members being integral with one end of an arc-shaped spring, the other end of which is integral with a clamping disc, said supporting members, springs and discs being disposed so as to cause each disc to be inserted in the cavity of a clip case in the housing with a portion of the disc extend outwardly through the apertures in the case adjacent one corner thereof and to resiliently abut one end wall of an adjacent case, when the spring clip unit is mounted in the housing with the elongated plate member covering the lengthwise extending aperture in the upper part of the housing.

4. A device as claimed in claim 3 wherein said housing comprising means for supporting the spring clip unit when inserted into the housing through the lengthwise extending aperture in the upper part thereof and wherein the ends of the spring supporting members of the spring clip unit are provided with hooks adapted to grip the complementary supporting members in the cavity of the housing.

* * * * *